US009690254B2

(12) United States Patent
Shiori et al.

(10) Patent No.: US 9,690,254 B2
(45) Date of Patent: Jun. 27, 2017

(54) DEVELOPING DEVICE, AND IMAGE FORMING APPARATUS AND PROCESS CARTRIDGE INCORPORATING SAME

(71) Applicants: Jun Shiori, Kanagawa (JP); Hideo Yoshizawa, Kanagawa (JP); Daisuke Hamada, Kanagawa (JP); Shingo Kuboki, Kanagawa (JP); Takahiro Adachi, Kanagawa (JP)

(72) Inventors: Jun Shiori, Kanagawa (JP); Hideo Yoshizawa, Kanagawa (JP); Daisuke Hamada, Kanagawa (JP); Shingo Kuboki, Kanagawa (JP); Takahiro Adachi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/139,280

(22) Filed: Apr. 26, 2016

(65) Prior Publication Data

US 2016/0342134 A1 Nov. 24, 2016

(30) Foreign Application Priority Data

May 18, 2015 (JP) ..... 2015-100738

(51) Int. Cl.
*G03G 15/00* (2006.01)
*G03G 15/08* (2006.01)
(Continued)

(52) U.S. Cl.
CPC ..... *G03G 21/1857* (2013.01); *G03G 15/5008* (2013.01); *G03G 15/757* (2013.01);
(Continued)

(58) Field of Classification Search
CPC ..... G03G 15/5008; G03G 15/757; G03G 21/1647; G03G 21/1676; G03G 21/1857; G03G 2221/1657
(Continued)

(56) References Cited

U.S. PATENT DOCUMENTS 5,619,316 A 4/1997 Shoji et al.
2009/0074506 A1 3/2009 Sugiyama et al.
(Continued)

FOREIGN PATENT DOCUMENTS

JP 1-027982 1/1989
JP 2-215635 8/1990
(Continued)

*Primary Examiner* — Sophia S Chen
(74) *Attorney, Agent, or Firm* — Duft Bornsen & Fettig, LLP

(57) ABSTRACT

An image forming apparatus includes a latent image bearer having a shaft to rotate in a normal direction for image formation and a reverse direction, a charging device, a latent image forming device, a developing device including a developer bearer having a shaft, a driving source, a drive transmission device to transmit a driving force from the driving source to the shaft of the latent image bearer and the shaft of the developer bearer. The developer bearer rotates in a predetermined direction during image formation and transports developer including toner to a developing range facing the latent image bearer, thereby developing the latent image on the latent image bearer. The drive transmission device is configured to inhibit transmission of the driving force to the shaft of the developer bearer when the latent image bearer rotates in the reverse direction.

7 Claims, 9 Drawing Sheets

(51) Int. Cl.
*G03G 21/18* (2006.01)
*G03G 21/16* (2006.01)

(52) U.S. Cl.
CPC ..... *G03G 21/1647* (2013.01); *G03G 21/1676* (2013.01); *G03G 2221/1657* (2013.01)

(58) Field of Classification Search
USPC ..... 399/167, 53, 111
See application file for complete search history.

(56) References Cited

U.S. PATENT DOCUMENTS

2009/0324279 A1* 12/2009 Miyahara ..... G03G 15/161 399/111 X
2011/0026958 A1* 2/2011 Shiori ..... G03G 15/0806 399/53
2011/0158692 A1* 6/2011 Handa ..... G03G 15/0813 399/167 X
2011/0211854 A1 9/2011 Shiori et al.
2011/0236071 A1* 9/2011 Shiraki ..... G03G 15/757 399/167 X
2012/0093528 A1 4/2012 Shiori et al.
2012/0230711 A1 9/2012 Shiori et al.
2013/0216251 A1* 8/2013 Watanabe ..... G03G 21/105 399/53
2014/0064756 A1 3/2014 Sugiyama et al.

FOREIGN PATENT DOCUMENTS

JP 6-118784 4/1994
JP 7-152219 6/1995
JP 8-211801 8/1996
JP 9-090754 4/1997
JP 9-101675 4/1997
JP 09-197917 A * 7/1997
JP 2004-252007 9/2004
JP 2007-069556 3/2007
JP 2009-069556 4/2009

* cited by examiner

DEVELOPING DEVICE, AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. §119(a) to Japanese Patent Application No. 2015-100738, filed on May 18, 2015, in the Japan Patent Office, the entire disclosure of which is hereby incorporated by reference herein.

BACKGROUND

Technical Field

Embodiments of the present invention generally relate to a developing device, and a process cartridge and an image forming apparatus, such as a copier, a printer, a facsimile machine, or a multifunction peripheral (MFP or multifunction machine) having at least two of copying, printing, facsimile transmission, plotting, and scanning capabilities, that include the developing device.

Description of the Related Art

There are image forming apparatuses in which a photoconductor serving as a latent image bearer and a developing roller serving as a developer bearer are driven by an identical driving motor (i.e., a single driving source).

SUMMARY

An embodiment of the present invention provides an image forming apparatus that includes a latent image bearer having a shaft to rotate in a normal direction for image formation and a reverse direction to the normal direction, a charging device to charge a surface of the latent image bearer, a latent image forming device to form a latent image on the latent image bearer, a developing device including a developer bearer having a shaft, a driving source, a drive transmission device to transmit a driving force from the driving source to the shaft of the latent image bearer and the shaft of the developer bearer. The developer bearer rotates in a predetermined direction during image formation and transports developer including toner to a developing range facing the latent image bearer, thereby developing the latent image on the latent image bearer. The drive transmission device is configured to inhibit transmission of the driving force to the shaft of the developer bearer when the latent image bearer rotates in the reverse direction.

In another embodiment, a developing device for an image forming apparatus includes the above-described developer bearer, a casing to contain the developer and accommodate the developer bearer, and a one-way clutch attached to the shaft of the developer bearer. The casing has an opening via which an inside of the casing communicates with the developing range. The one-way clutch inhibits transmission of a driving force from a driving source to the shaft of the developer bearer when the latent image bearer of the image forming apparatus rotates in a reverse direction to a normal direction for image formation.

Yet another embodiment provides a process cartridge to be removably installed in an image forming apparatus. The process cartridge includes the latent image bearer to bear the latent image, the above-described developing device to develop the latent image on the latent image bearer, and a common holder to hold the latent image bearer and the developing device as a single unit.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
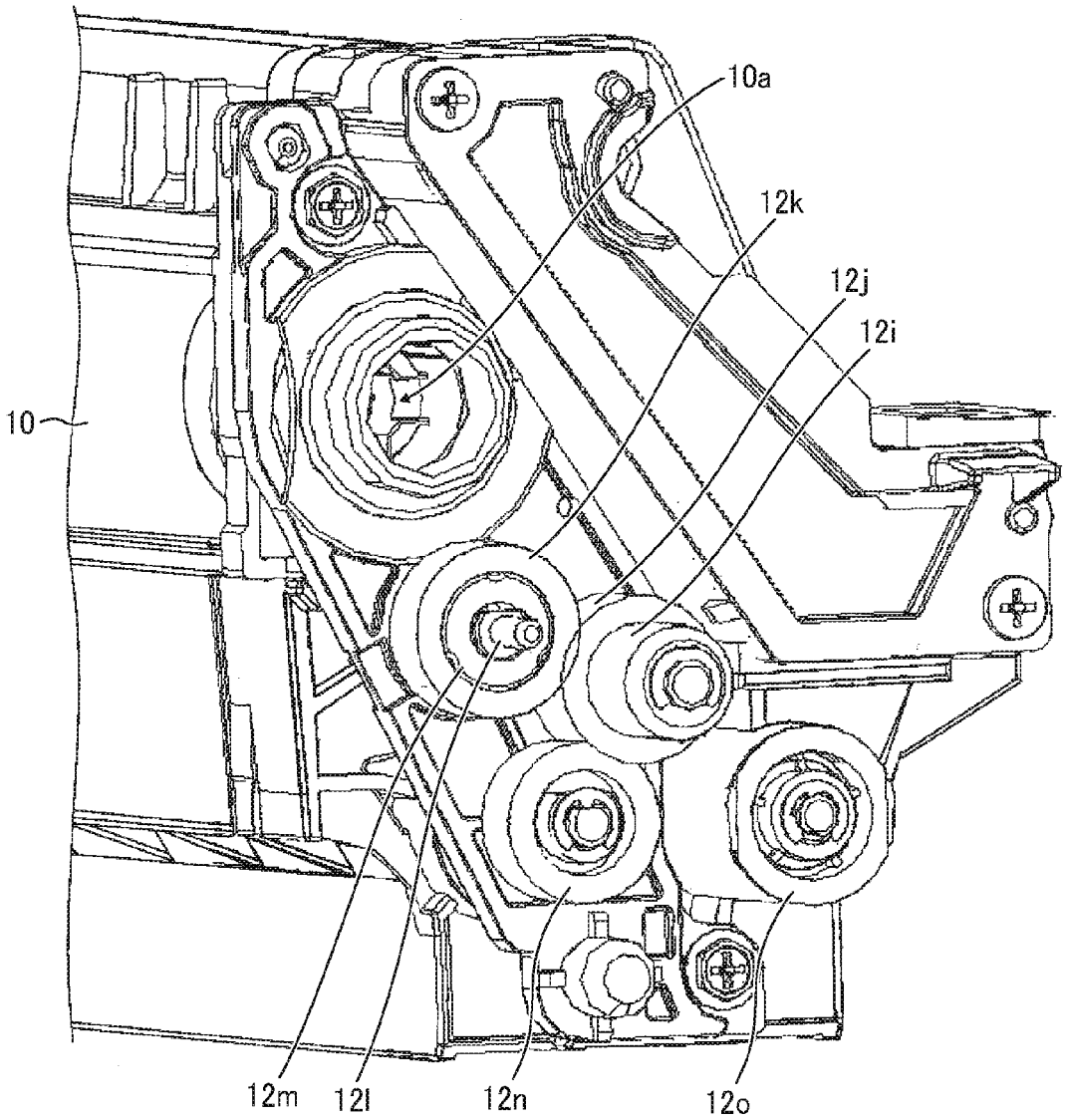
FIG. 1 is a perspective view illustrating a drive transmission device for an image forming unit according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, an image forming apparatus 100 according to an embodiment of the present invention is described. For example, the image forming apparatus 100 is a copier.

Figure 4:
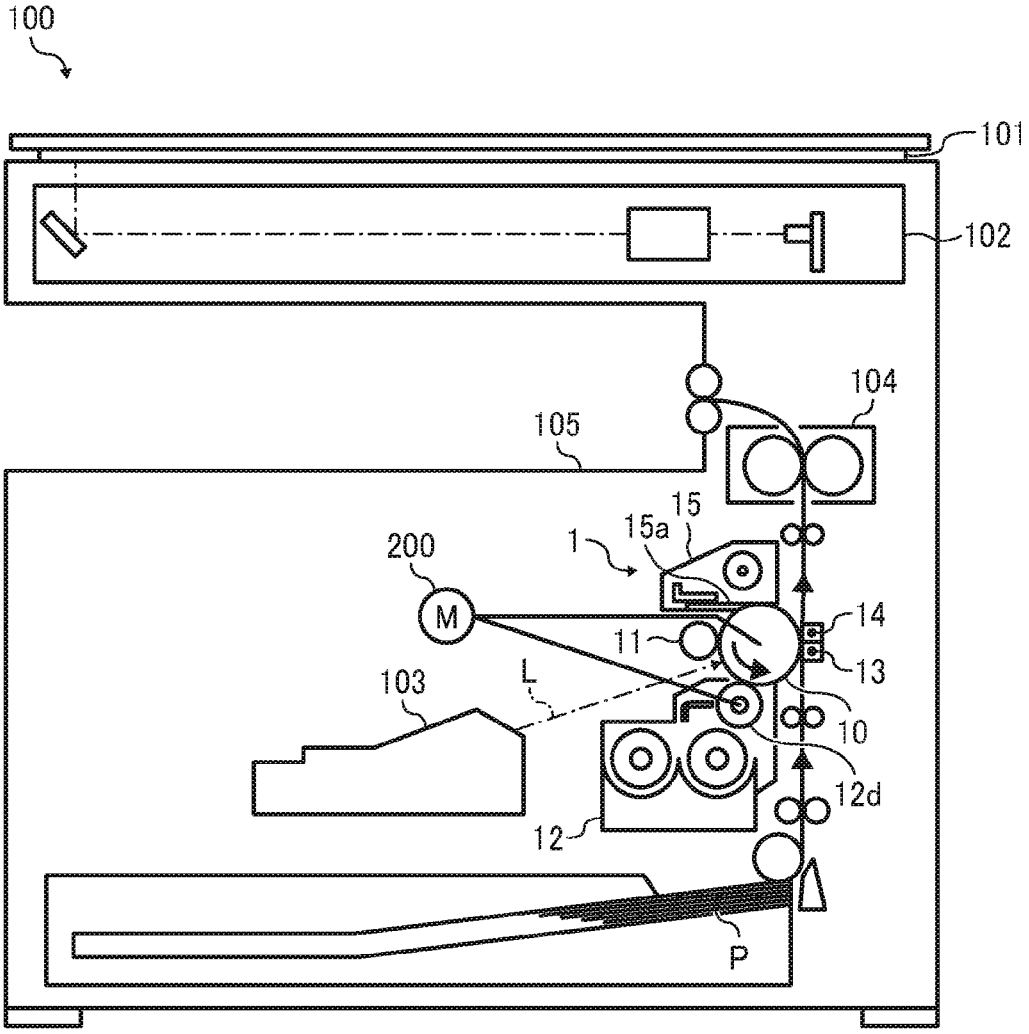
FIG. 4 is a schematic cross-sectional view illustrating an image forming apparatus including the image forming unit illustrated in FIG. 1.

FIG. 4 is a schematic cross-sectional view illustrating the image forming apparatus 100 including a developing device 12 according to the present embodiment.

Referring to FIG. 4, a configuration of the image forming apparatus 100 is described.

The image forming apparatus 100 includes an exposure glass 101 on which a document is placed, an optical reading device 102 to scan an image on the document, an image forming unit 1 including a photoconductor 10, and a sheet feeder disposed in a lower section of the image forming apparatus 100.

When a user presses a start button of the image forming apparatus 100, the optical reading device 102 scans an image on the document, and, simultaneously, the sheet feeder feeds a sheet P of recording media from the lower section to a position between the photoconductor 10 and a transfer device 13 as indicated by arrows in FIG. 4. The photoconductor 10 rotates counterclockwise in FIG. 4

The image forming unit 1 includes a charging device 11 disposed facing the photoconductor 10 to uniformly charge the surface of the photoconductor 10, a developing device 12 to develop a latent image, and a photoconductor cleaning device 15.

The image forming apparatus 100 further includes an optical writing device 103 to direct a laser beam L onto the surface of the photoconductor 10, thereby forming an electrostatic latent image thereon, corresponding to the scanned image of the document. The optical writing device 103 serves as a latent image forming device.

As the photoconductor 10 rotates downstream in the direction indicated by an arrow, the electrostatic latent image on the photoconductor 10 passes through a developing range, where the photoconductor 10 faces a developing roller 12*d* (in FIG. 5) of the developing device 12. The developing roller 12*d* bears developer including toner and carrier. In the developing range, the toner in the developer on the developing roller 12*d* adheres to the photoconductor 10, thereby sequentially developing the electrostatic latent image into a visible image (i.e., a toner image).

The transfer device 13 transfers the toner image onto the sheet P, which is fed to the position between the photoconductor 10 and the transfer device 13 as described above.

The image forming apparatus 100 further includes a sheet separator 14 and a fixing device 104. The sheet separator 14 discharges electricity (attenuates electrical charges) to separate, from the photoconductor 10, the sheet P electrostatically adhering to the photoconductor 10. The fixing device 104 fixes the image on the sheet P, after which the sheet P is ejected to an output tray 105. Alternatively, instead of the sheet separator 14, the image forming apparatus 100 includes a stripping claw to mechanically separate the sheet P from the photoconductor 10.

A cleaning blade 15*a* of a photoconductor cleaning device 15 removes toner remaining on the photoconductor 10, and a discharge lamp initialize the surface potential of the photoconductor 10. At least two of the photoconductor 10, the charging device 11, the developing device 12, and the photoconductor cleaning device 15 can are united together into a process cartridge.

In FIG. 4, a reference numeral 200 represents a driving source to rotate the photoconductor 10 and a developing sleeve 12*d*-2 of the developing roller 12*d*.

Figure 5:
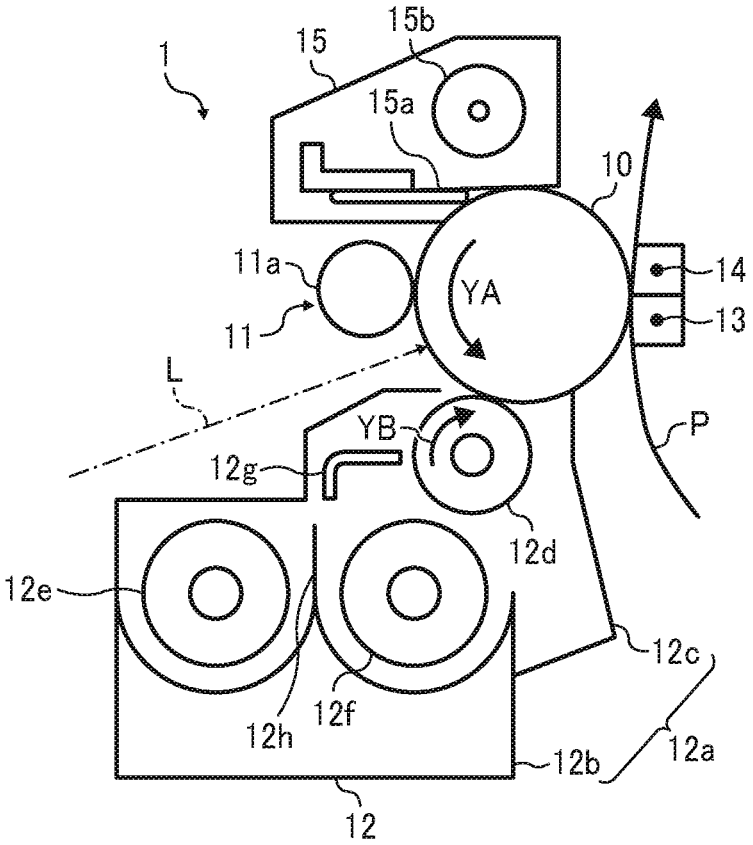
FIG. 5 is an enlarged view of an image forming unit according to an embodiment.

FIG. 5 is an enlarged view of the image forming unit 1.

In the configuration illustrated in FIG. 5, the image forming unit 1 includes the photoconductor 10, the charging device 11, the developing device 12, and the photoconductor cleaning device 15, which are supported by a common holder 1A (illustrated in FIG. 6) as a single unit (i.e., a process cartridge). The image forming unit 1 is removably installable in the body of the image forming apparatus 100. In the image forming unit 1, the charging device 11, the developing device 12, and the photoconductor cleaning device 15 are disposed around the photoconductor 10. In the image forming unit 1 according to the present embodiment, the charging device 11 employs a charging roller 11*a*, and the photoconductor cleaning device 15 employs the cleaning blade 15*a* to clean the surface of the photoconductor 10. The photoconductor cleaning device 15 includes a conveyor 15*b* to transport the toner (i.e., residual toner) collected by the cleaning blade 15*a*, and the collected toner is transported to the outside of the photoconductor cleaning device 15. The collected toner is transported from the photoconductor cleaning device 15 to the developing device 12 and reused (or recycled) in image developing.

Image forming operations of the image forming apparatus 100 is described below with reference to FIGS. 4 and 5.

The document is placed on the exposure glass 101. When the start button is pressed in this state, the optical reading device 102 optically reads image data of the document set on the exposure glass 101.

More specifically, the optical reading device 102 scans the image on the document on the exposure glass 101 with light emitted from an illumination lamp. The light reflected from the surface of the document is imaged on a sensor via mirrors and lenses. The image data of the document read by the sensor is converted into electrical image signals.

Then, the image data is transmitted to the optical writing device 103 (i.e., an exposure device). Then, the optical writing device 103 directs a laser beam L to the photoconductor 10 according to image data.

The photoconductor 10 rotates in the direction indicated by arrow YA illustrated in FIG. 5. The surface of the photoconductor 10 is charged uniformly at a position facing the charging roller 11*a* of the charging device 11 (a charging process). Then, the surface of the photoconductor 10 has a predetermined charge potential. Subsequently, the surface of the photoconductor 10 thus charged reaches a position to receive the laser beam L. The optical writing device 103 emits the laser beam L from a light source according to the image signals (exposure process).

A polygon mirror rotating at high speed deflects the laser beam L in the direction of a rotation axis of the photoconductor 10 (i.e., a main scanning direction) so that the laser beam L scans the surface of the photoconductor 10. Thus, an electrostatic latent image is formed on the photoconductor 10 charged by the charging device 11.

Subsequently, the surface of the photoconductor 10 bearing the electrostatic latent image reaches a position facing the developing device 12. The developing device 12 contains two-component developer including toner (toner particles) and carrier (carrier particles) and supplies the toner to the surface of the photoconductor 10, thereby developing the latent image thereon into a toner image (development process). Then, the surface of the photoconductor 10 reaches a position to face the sheet P. At that position, the transfer device 13 including a transfer bias charger is disposed to contact or abut with a back side of the sheet P. The transfer bias charger and the photoconductor 10 facing the transfer bias charger via the sheet together form a transfer section. In the transfer section, the toner image on the photoconductor 10 is transferred onto the sheet P (transfer process). It is to be noted that, instead of the transfer bias charger, a transfer bias roller can be used.

Subsequently, the surface of the photoconductor 10 reaches a position facing the photoconductor cleaning device 15, where the cleaning blade 15*a* collects the toner (i.e., untransferred toner) remaining on the photoconductor 10 (cleaning process).

Subsequently, the surface of the photoconductor 10 passes through a discharge section, where electrical potentials remaining on the surface of the photoconductor 10 are removed. Thus, a sequence of image forming processes performed on the photoconductor 10 is completed, and the photoconductor 10 is prepared for subsequent image formation.

The photoconductor cleaning device 15 includes the conveyor 15*b* to transport the toner (i.e., residual toner) and the like collected by the cleaning blade 15*a* to the outside of the photoconductor cleaning device 15. The collected toner is transported from the photoconductor cleaning device 15 to the developing device 12 and reused in image developing. The sheet P to which the toner image is transferred in the transfer section is sent to the fixing device 104. In the fixing device 104, a fixing belt and a pressing roller are pressed against each other, forming a fixing nip, where the toner image is fixed on the sheet P with heat and pressure. Then, the sheet P is transported by a pair of discharge rollers and stacked on the output tray 105. Then, a sequence of image forming processes is completed.

As illustrated in FIG. 5, the developing device 12 includes a casing 12*a* that includes a lower case 12*b* and an upper case 12*c*.

Figure 6:
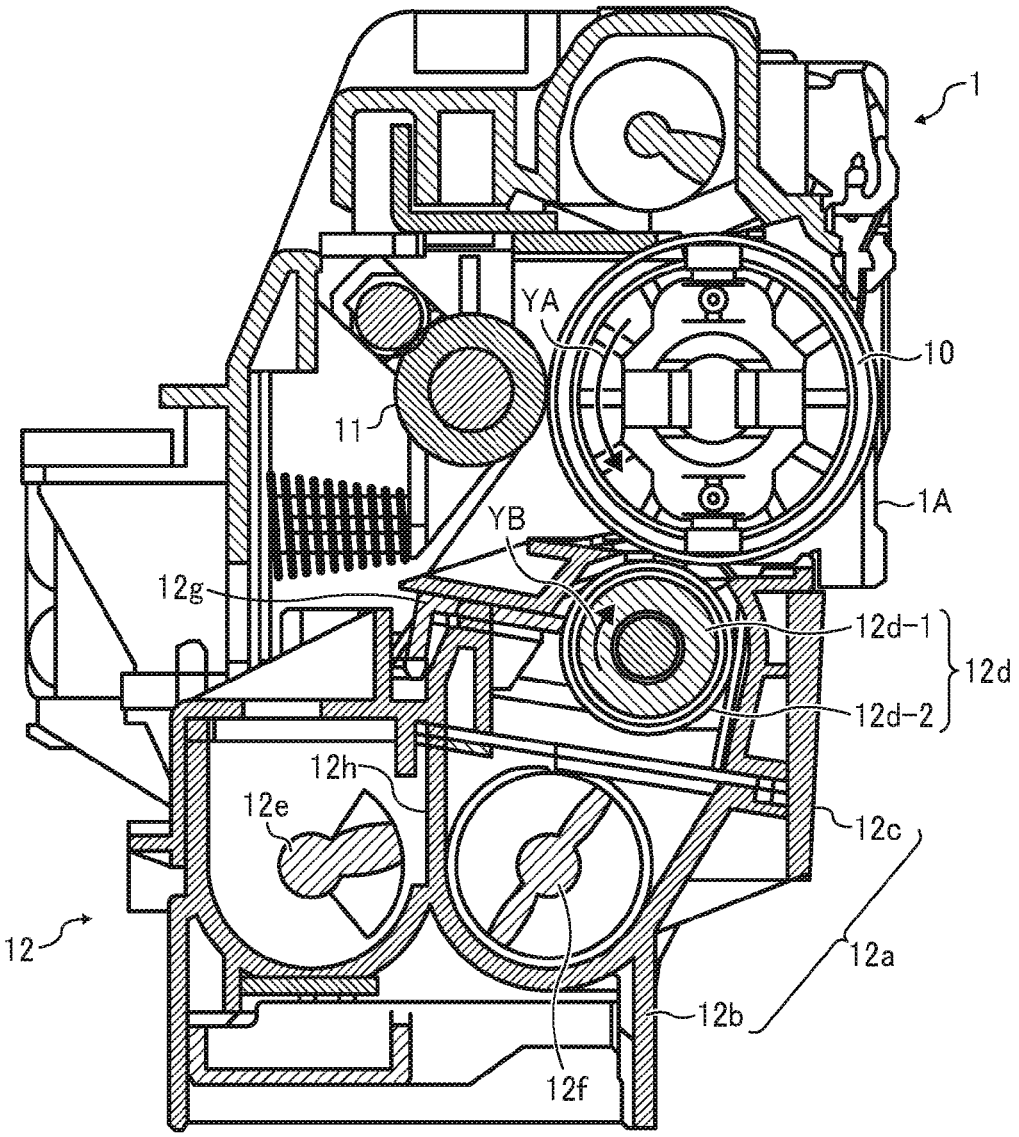
FIG. 6 is a cross-sectional view of the image forming unit.
Figure 7A:
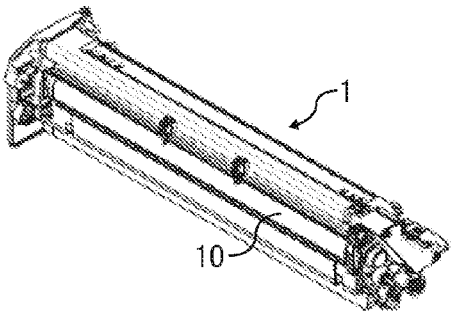
FIG. 7A is a perspective view of the image forming unit.
Figure 7B:
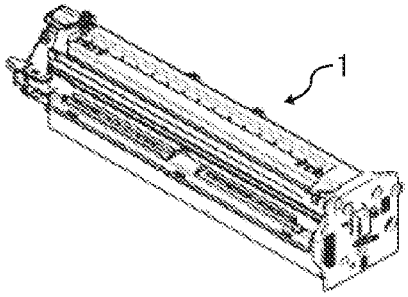
FIG. 7B is another perspective view of the image forming unit.
Figure 7C:
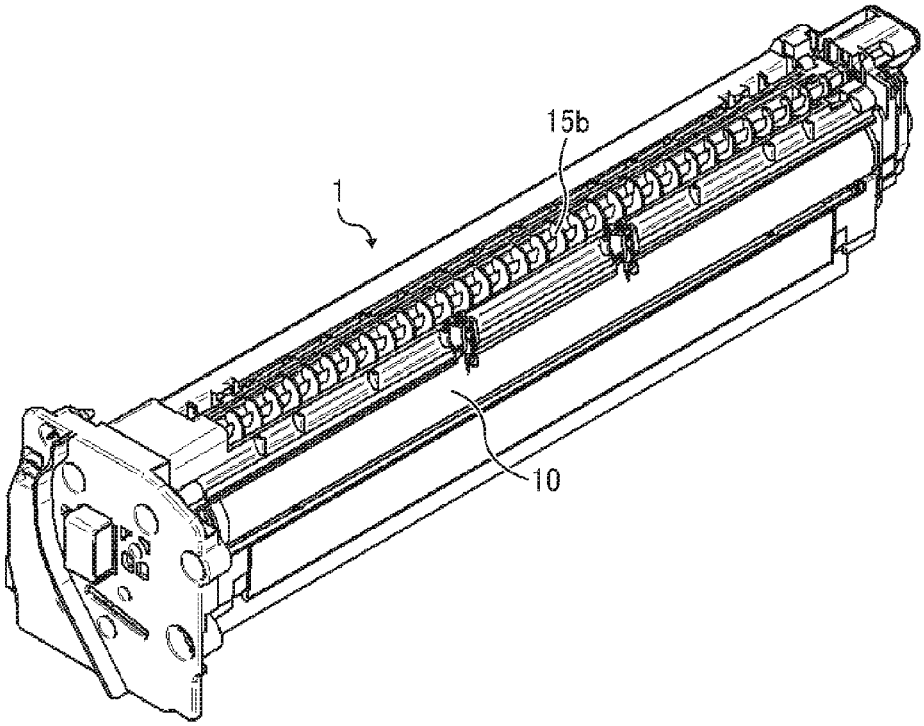
FIG. 7C is a perspective view of the image forming unit from which a casing of a photoconductor cleaning device is removed.

FIG. 6 is an enlarged cross-sectional view of the image forming unit 1. FIG. 7A is a perspective view of the image forming unit 1. FIG. 7B is a perspective view of the image forming unit 1 as viewed from a different angle. FIG. 7C is a perspective view of the image forming unit 1 from which a casing of the photoconductor cleaning device 15 is removed.

In FIG. 7C, the conveyor 15*b* transports the collected toner (i.e., residual toner and the like collected by the cleaning blade 15*a*) in the longitudinal direction of the photoconductor cleaning device 15 and discharges the collected toner outside the photoconductor cleaning device 15. Specifically, the collected toner drops down at the end (the distal side in FIG. 7C) in the longitudinal direction of the photoconductor cleaning device 15 and passes through a space inside an inclined container at the end (the proximal side in FIG. 7A) in the longitudinal direction. Then, the collected toner is transported to the developing device 12 and reused in image developing.

In FIGS. 5 and 6, the developing device 12 includes the developing roller 12*d* serving as a developer bearer disposed facing the photoconductor 10, developer conveyors, namely, a supply screw 12*f* and a conveying screw 12*e* (a stirring and conveying member), a doctor blade 12*g* serving as a developer regulator, and a partition 12*h*. Each of the supply screw 12*f* and the conveying screw 12*e* includes a rotation shaft and a spiral blade winding around the rotation shaft and transports, by rotation, the developer in an axial direction (longitudinal direction) thereof.

The developing roller 12*d* includes a magnet roller 12*d*-1 including multiple stationary magnets and the developing sleeve 12*d*-2 that rotates around the magnet roller 12*d*-1. Although the magnet roller 12*d*-1 includes the multiple magnets, the magnet roller 12*d*-1 is depicted as a single component in FIG. 6 for simplicity. The developing sleeve 12*d*-2 contains the developing sleeve 12*d*-2 and is a rotatable, cylindrical member made of a nonmagnetic material.

The magnet roller 12*d*-1 has multiple magnetic poles, for example, five magnetic poles of: a first pole (north pole or N pole) disposed facing the developer regulator; a second pole (south pole or S pole) disposed facing the photoconductor 10; a third pole (N pole) serving as a conveyance pole disposed facing the upper case 12*c* downstream from the second pole in the direction of rotation of the developing sleeve 12*d*-2; a fourth pole (N pole) disposed downstream from the third pole in the direction of rotation of the developing sleeve 12*d*-2; and a fifth pole (S pole) disposed downstream from the fourth pole in the direction of rotation of the developing sleeve 12*d*-2 and serving as a developer scooping pole. In a range from the third pole (N pole) and the fourth pole (N pole), the developer is separated from the developing roller 12*d* and falls to the lower case 12*b*.

The casing 12*a* of the developing device 12 contains two-component developer including toner and carrier (one or more additives can be included).

Figure 2:
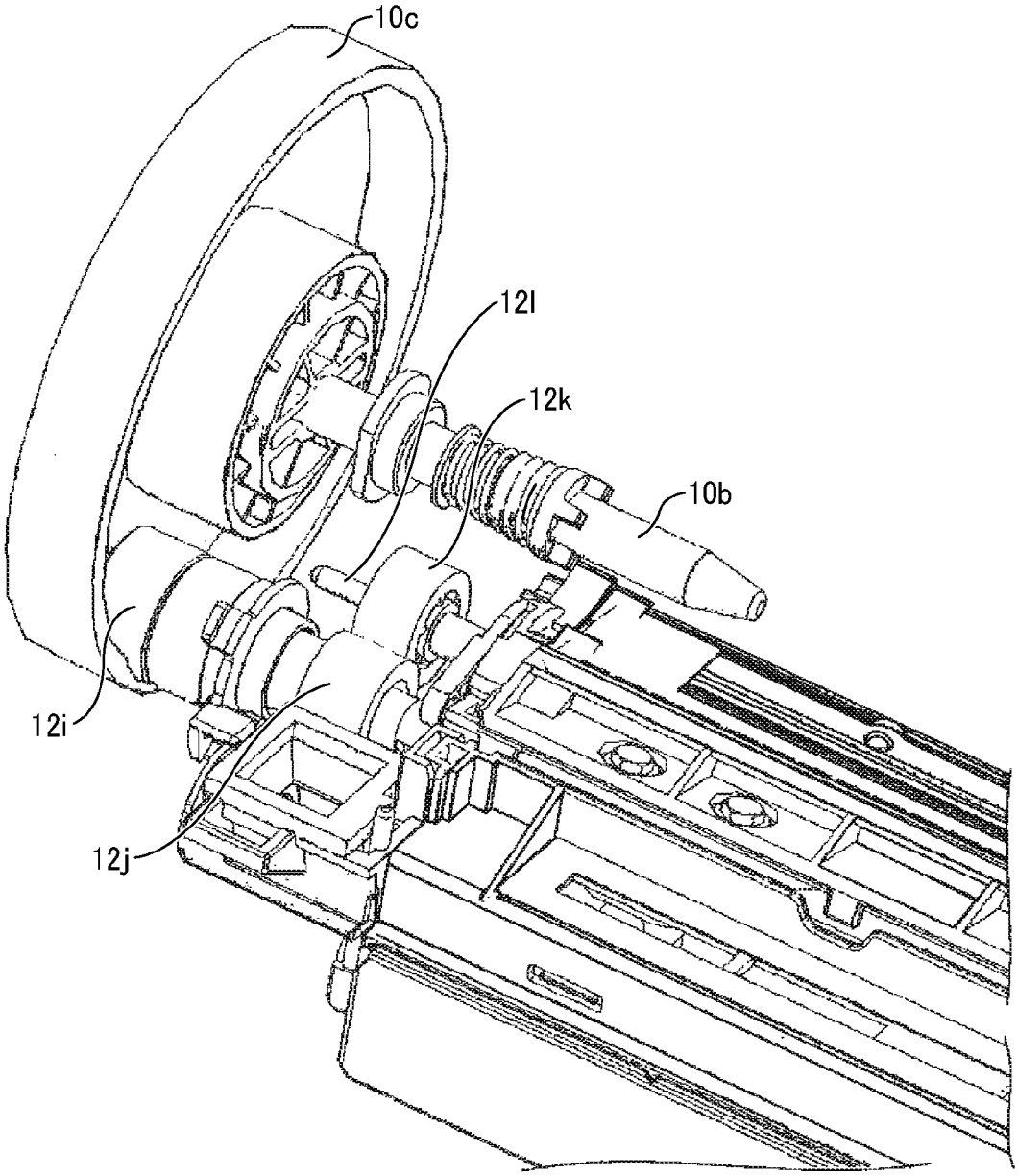
FIG. 2 is a cross-sectional view illustrating a drive transmission mechanism for a developing device in the image forming unit illustrated in FIG. 1.

The supply screw 12*f* and the conveying screw 12*e* transport developer in the longitudinal direction (the direction along a rotation shaft 12*l* of the developing sleeve 12*d*-2 illustrated in FIGS. 1 and 2,) to form a circulation passage inside the developing device 12. The supply screw 12*f* and the conveying screw 12*e* are disposed side by side in a lateral direction in FIG. 6, and a supply compartment and a stirring compartment are formed with the partition 12*h* disposed between the conveying screw 12*e* and the supply screw 12*f*.

Additionally, in the upper case 12*c*, the doctor blade 12*g* is disposed upstream in the direction of rotation of the developing sleeve 12*d*-2 from the developing range, where the developing sleeve 12*d*-2 faces the photoconductor 10. The doctor blade 12*g* is disposed approximately horizontal in the normal direction of the developing roller 12*d* and adjusts the amount of developer, borne on the developing sleeve 12*d*-2, conveyed to the developing range.

Toner is supplied into the developing device 12 from a toner supply inlet 12*p* (illustrated in FIGS. 3A and 3B) disposed above the conveying screw 12*e* and at the end in the longitudinal direction of the conveying screw 12*e*. The collected toner (hereinafter also "reused toner") is supplied from a reuse toner inlet 12*q* disposed on the left of the toner supply inlet 12*p* in FIGS. 3A and 3B. The supplied toner and the reused toner, together with the developer in the developing device 12, are transported in the opposite directions by the conveying screw 12*e* and the supply screw 12*f*, stirred together, and circulated. The supply screw 12*f* supplies a portion of the developer thus stirred to the surface of the developing sleeve 12*d*-2 serving as the developer bearer, and the developer is carried thereon. After the doctor blade 12*g* adjusts the amount of developer carried on the developing sleeve 12*d*-2, the developer is transported to the developing range. In the developing range, the toner in developer on the developing sleeve 12*d*-2 adheres to the latent image on the surface of the photoconductor 10, developing the latent image.

The developing device 12 is filled with the developer in which the toner and the carrier (i.e., magnetic particles) are mixed uniformly. The conveying screw 12*e* and the supply screw 12*f* disposed side by side laterally rotate to transport the developer and simultaneously agitate the developer with fresh toner supplied through the toner supply inlet 12*p*. Thus, the toner and carrier are mixed uniformly, and charge potentials are given to the toner.

While transporting the uniformly mixed developer in the longitudinal direction, the supply screw 12*f* adjacent to and parallel to the developing sleeve 12*d*-2 supplies the developer to the developing sleeve 12*d*-2. Then, the magnetic force exerted by the fifth pole (the developer scooping pole) of the magnet roller 12*d*-1 inside the developing sleeve 12*d*-2 attracts the developer to the outer surface of the developing sleeve 12*d*-2. As the developing sleeve 12*d*-2 rotates clockwise as indicated by arrow YB illustrated in FIG. 6, the developer carried thereon is adjusted by the doctor blade 12*g* and transported to the developing range. A developing bias voltage is applied to the developing sleeve 12*d*-2, and thus a developing electrical field is generated between the developing sleeve 12*d*-2 and the photoconductor 10 in the developing range. The developing electrical field promotes the supply of toner from the surface of the developing sleeve 12*d*-2 to the surface of the photoconductor 10, thereby developing the latent image on the photoconductor 10. The developer on the developing sleeve 12*d*-2 that has passed through the developing range is collected in the supply compartment inside the developing device 12 as the developing sleeve 12*d*-2 rotates. That is, the developer is supplied from the supply compartment to the developing sleeve 12*d*-2, and the developer on the developing sleeve 12*d*-2 that has passed through the developing range is collected in the supply compartment. The supplying and the collecting occur in the entire span of the supply compartment in the longitudinal direction thereof.

While the supply screw 12*f* transports the developer in the supply compartment, a constant amount of developer is scooped from the supply compartment onto the surface of the developing sleeve 12*d*-2 by the rotation of the supply screw 12*f* as well as the magnetic force exerted from the fifth pole serving as the developer scooping pole. After adjusted by the doctor blade 12*g*, the developer on the developing sleeve 12*d*-2 passes through the developing range and reaches a position of a developer release pole formed by the third and fourth magnetic poles adjacent to each other, having the same polarity (N pole). The developer is separated from the developing sleeve 12*d*-2 by the magnetic force exerted from the developer release pole and is collected in the supply compartment.

The supply screw 12*f* in the supply compartment transports the developer separated from the developing sleeve 12*d*-2 at the developer release position in the axial direction of the supply screw 12*f* and in the direction opposite to the direction in which the conveying screw 12*e* transports the developer. Through a first communicating opening, the downstream end of the supply compartment in which the supply screw 12*f* is disposed communicates with the upstream end of the stirring compartment in which the conveying screw 12*e* is disposed. At the downstream end of the supply compartment, the developer is pushed out the first communicating opening by the developer transported from behind. Then, the developer reaches the upstream end of the stirring compartment. As the conveying screw 12*e* inside the stirring compartment rotates, the developer is transported to the downstream end of the stirring compartment.

The upstream end of the supply compartment communicates with the downstream end of the stirring compartment via a second communicating opening. The developer transported to the downstream end of the stirring compartment passes through the second communicating opening to the upstream end of the supply compartment.

As the developer is transported from the downstream end of the supply compartment to the stirring compartment and further from the downstream end of the stirring compartment to the supply compartment, the developer circulates inside the developing device 12.

The amount of developer in the supply compartment decreases toward the downstream side in the developer conveyance direction since the developer is scooped up to the developing roller 12*d* while being transported by the supply screw 12*f*. In the supply compartment, the supply screw 12*f* further collects and transports the developer that has passed through the developing range and left the developing sleeve 12*d*-2, and the amount of developer therein increases toward the downstream side in the developer conveyance direction. Accordingly, the amount of developer in the supply compartment is almost equal between the upstream side and the downstream side.

The toner supply inlet 12*p* is disposed at the upstream end of the stirring compartment, and fresh toner is supplied from a toner container via a toner supply device and a toner hopper to the toner supply inlet 12*p* as required. Thus, in the stirring compartment, the conveying screw 12*e* stirs and transports a small amount of developer supplied, as required, from the toner supply inlet 12*p* and a small amount of reused toner supplied from the reuse toner inlet 12*q*, together with the developer in the stirring compartment, and the amount of developer therein is kept almost equal between the upstream side and the downstream side. Accordingly, in circulating the developer (the carrier in particular) in the stirring compartment and the supply compartment, fluctuations in the amount of developer are inhibited, thereby securing uniform circulation.

As described above, in the developing device 12, the supply screw 12*f* and the conveying screw 12*e* rotate, and simultaneously the developer is attracted to the developing sleeve 12*d*-2 by the magnetic attraction exerted by the magnet roller 12*d*-1. Additionally, the developing sleeve 12*d*-2 is rotated at a predetermined speed ratio to the speed of the photoconductor 10 to scoop the developer to the developing range consecutively. The developer is separated from the developing sleeve 12*d*-2 by the developer release pole formed by the third and fourth poles generating a repulsive magnetic force. The developer transported to the area in which the repulsive magnetic force is exerted is released in the composite direction of the direction normal to the developing sleeve 12*d*-2 and the direction tangential to the rotation of the developing sleeve 12*d*-2. Then, the developer is collected in the supply compartment.

In some cases, the photoconductor 10 is rotated in the direction reverse to a normal direction for image formation. In the image forming apparatus 100, in removal of the untransferred toner remaining on the photoconductor 10, a rotation shaft 10*b* (illustrated in FIG. 2) of the photoconductor 10 is rotated in the direction reverse to the normal direction for image formation.

The photoconductor and the developing roller can be driven by an identical driving motor, as in the present embodiment. In such a configuration, if the rotation shaft of the developing roller rotates in the direction reverse as the photoconductor rotates in the revere direction, inconveniences may arise.

Specifically, in developing devices employing two-component developer including toner and carrier, typically, the two-component developer is caused to stand on end on the surface of the developing sleeve containing multiple magnetic poles, thereby generating a magnetic brush. As the developing roller rotates, the magnetic brush thereon contacts the electrostatic latent image on the surface of the photoconductor in the developing range. Then, due to an electrostatic attraction between the magnetic brush and the electrostatic latent image, the toner in the developer moves to the electrostatic latent image.

Figure 8:
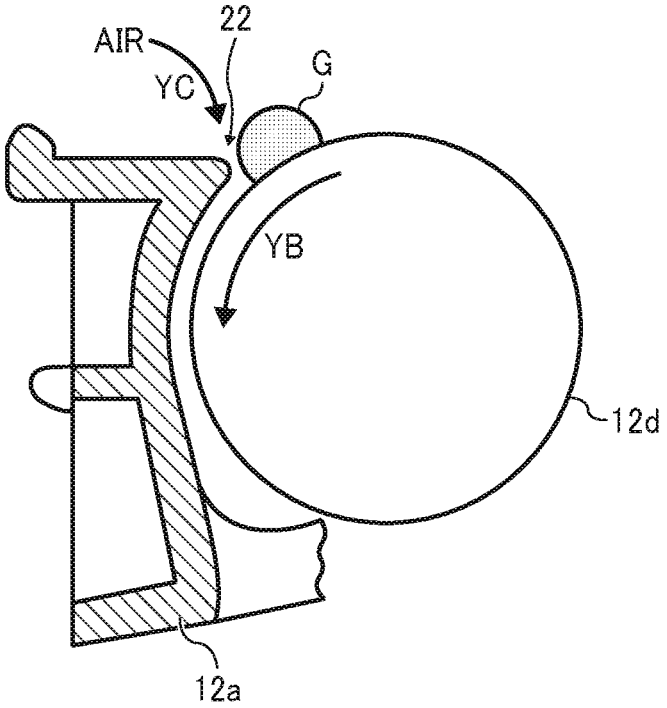
FIG. 8 is a schematic view illustrating generating of sucking-in airflow in a developing device.

FIG. 8 is a schematic view illustrating air sucked in the casing 12*a* as the developing roller 12*d* rotates.

Referring to FIG. 8, the casing 12*a* includes an opening 22 through which the inside of the casing 12*a* communicates the developing range. That is, the developing roller 12*d* accommodated in the casing 12*a* is exposed through the opening 22.

In FIG. 8, during image formation, the developing roller 12*d* (the developing sleeve 12*d*-2 in particular) rotates in the normal direction indicated by arrow YB. Downstream from the developing range, the tip of the magnetic brush (i.e., developer G) contacts the casing 12*a* while moving in the direction indicated by arrow YB. This movement causes sucking-in airflow that flows in the direction indicated by arrow YC in FIG. 8, into the casing 12*a* (i.e., a developer container) through an opening 22, and the developer G is collected through the opening 22 in the casing 12*a*. With the sucking-in airflow, floating developer (toner in particular), which has escaped from the rotation of the developing roller 12*d*, and the toner on the developing roller 12*d* downstream from the developing range is collected in the casing 12*a*.

Reverse rotation of the photoconductor 10 is described below.

While the cleaning blade 15*a* keeps collecting the residual toner, paper fibers, dust, or the like (i.e., residual materials) from the photoconductor 10, it is possible that the residual materials accumulate on the upstream side of the cleaning blade 15*a* in the direction of rotation of the photoconductor 10, and the residual materials enter the gap between end of the cleaning blade 15*a* and the surface of the photoconductor 10. That is, cleaning becomes defective. In view of the foregoing, the photoconductor 10 is rotated in reverse to draw away the residual materials from the cleaning blade 15*a*. Subsequently, the photoconductor 10 is rotated in the normal direction for image formation to collect the residual materials with the cleaning blade 15*a* properly contacting the surface of the photoconductor 10.

If the developing roller 12*d* is rotated in the reverse direction as well when the photoconductor rotates in the reverse direction for inhibiting defective cleaning of the photoconductor, the following inconvenience may arise. While the developing roller 12*d* rotates in the reverse direction, in the opening 22, flowing-out airflow flowing to the outside of the casing 12*a* is generated. It is possible that, transported by the flowing-out airflow, the toner leaks outside the casing 12*a* and adheres to the casing 12*a* of the developing device or the holder 1A of the image forming unit 1, for example.

Next, features of the present embodiment are described in further detail below.

Figure 3A:
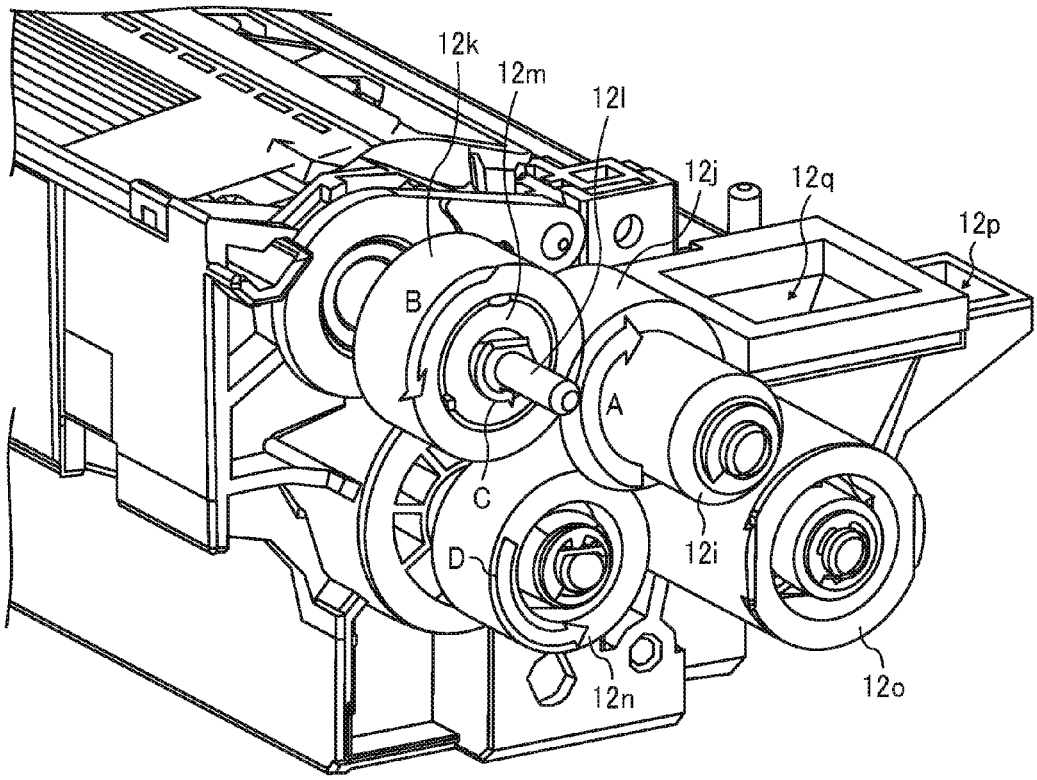
FIG. 3A is a perspective view illustrating a state of drive transmission to the developing device during image formation.
Figure 3B:
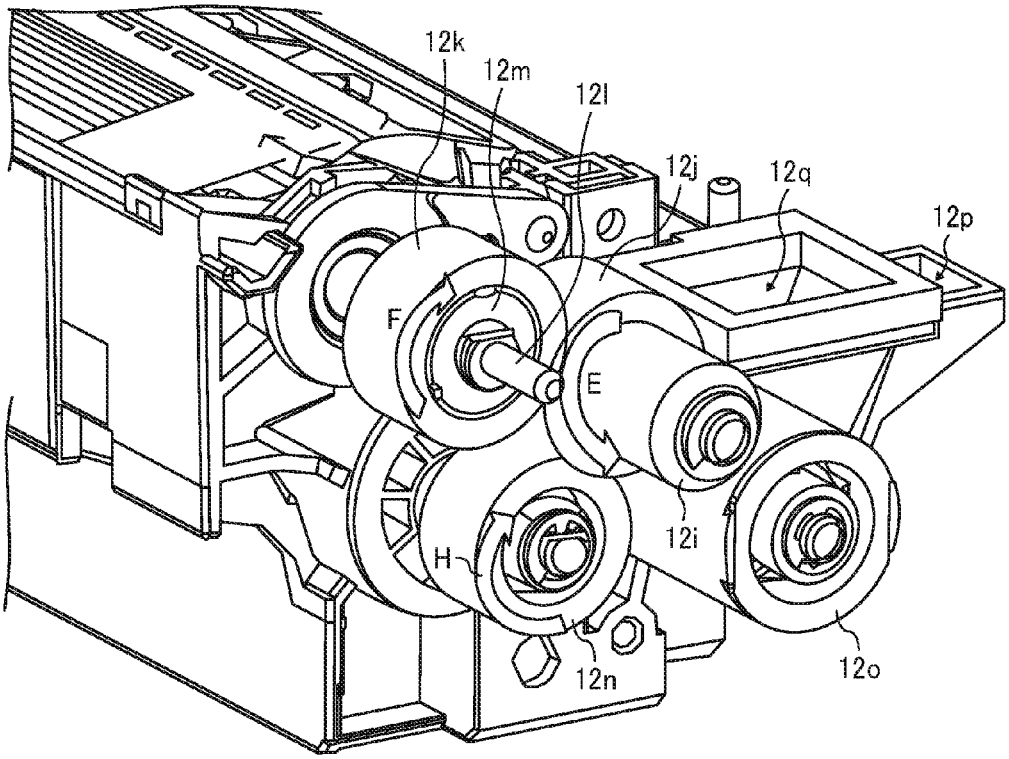
FIG. 3B is a perspective view illustrating a state of the drive transmission while a photoconductor rotates in a reverse direction to inhibit defective cleaning of the photoconductor.

FIG. 1 is a perspective view illustrating a drive transmission device for the image forming unit 1. FIG. 2 is a cross-sectional view of drive transmission for the developing device 12. FIG. 3A is a perspective view illustrating the drive transmission to the developing device 12 during image formation. FIG. 3B is a perspective view illustrating the drive transmission while the photoconductor 10 rotates in reverse to inhibit defective cleaning of the photoconductor 10.

In a center hollow 10*a* inside the cylindrical photoconductor 10 illustrated in FIG. 1, a rotation shaft 10*b* of the photoconductor 10 is fitted to engage therewith. As illustrated in FIG. 2, a photoconductor driving gear 10*c* is attached to the rotation shaft 10*b* of the photoconductor 10. The photoconductor driving gear 10*c* transmits the driving force to a developing driving gear 12*i* from the driving source 200 illustrated in FIG. 4, which is a driving motor such as a direct-current (DC) servo, a stepping motor, or the like. The rotation shaft 10*b* of the photoconductor 10 is fitted in a center of the photoconductor driving gear 10*c* to engage therewith. Internal teeth on the inner circumference of the photoconductor driving gear 10*c* mesh with external teeth of the developing driving gear 12*i*. A developing driving input gear 12*j* is disposed coaxially with the developing driving gear 12*i*, and external teeth of the developing driving input gear 12*j* mesh with external teeth at the outer circumference of a developing sleeve gear 12*k*. The developing sleeve gear 12*k* is attached to a rotation shaft 12*l* of the developing sleeve 12*d*-2.

The developing sleeve gear 12*k* contains a one-way clutch 12*m* illustrated in FIG. 1. The one-way clutch 12*m* is a clutch to transmit rotation only in a predetermined direction. When the developing sleeve gear 12*k* rotates in a first direction for image formation, the one-way clutch 12*m* meshes with the rotation shaft 12*l* of the developing sleeve 12*d*-2. When the developing sleeve gear 12*k* rotates in a second direction reverse to the first direction for image formation, the one-way clutch 12*m* does not mesh with the rotation shaft 12*l* of the developing sleeve 12*d*-2. Then, the developing sleeve gear 12*k* and the one-way clutch 12*m* rotate idle.

A conveying-screw driving gear 12*o* is disposed on the rotation shaft of the conveying screw 12*e* illustrated in FIG. 6. A supply-screw driving gear 12*n* is disposed on the rotation shaft of the supply screw 12*f* illustrated in FIG. 6. It is to be noted that the one-way clutch 12*m* can be contained in an intermediate gear in the transmission gear train between an output shaft of the driving source 200 (e.g., the driving motor) and the rotation shaft 12*l* of the developing sleeve 12*d*-2. For example, the one-way clutch 12*m* can be contained the developing driving input gear 12*j* serving as the intermediate gear to transmit the driving force of the driving motor to the rotation shaft 12*l* of the developing sleeve 12*d*-2.

The photoconductor driving gear 10*c*, the developing driving gear 12*i*, the developing driving input gear 12*j*, the developing sleeve gear 12*k*, and the one-way clutch 12*m* together serve as the drive transmission device to transmit the driving force from the driving source 200 to the shaft of the latent image bearer (the photoconductor 10) and the shaft of the developer bearer (the developing sleeve 12*d*-2).

Descriptions are given below of drive transmission to the developing device 12 during image formation and during reverse rotation of the photoconductor 10 to inhibit defective cleaning, with reference to the drawings.

In the drive transmission device for the developing device 12, during image formation, as the photoconductor driving gear 10*c* illustrated in FIG. 2 rotates in the direction for image formation, the developing driving gear 12*i* (illustrated in FIG. 1) meshing with the photoconductor driving gear 10*c* rotates. The developing driving input gear 12*j*, which is disposed on the identical shaft to which the developing driving gear 12*i* is disposed, rotates in the direction indicated by arrow A (hereinafter "rotation direction A") illustrated in FIG. 3A. This rotation is transmitted to the developing sleeve gear 12*k* meshing with the developing driving input gear 12*j*, and the developing sleeve gear 12*k* rotates in the direction indicated by arrow B (hereinafter "rotation direction B") illustrated in FIG. 3A.

The one-way clutch 12*m* contained in the developing sleeve gear 12*k* rotates in the direction indicated by arrow C (hereinafter "rotation direction C") in FIG. 3A, which is identical to the rotation direction B of the developing sleeve gear 12*k*. The one-way clutch 12*m* meshes with the rotation shaft 12*l* of the developing sleeve 12*d*-2, and the rotation shaft 12*l* of the developing sleeve 12*d*-2 rotates in the rotation direction C in FIG. 3A, together with the one-way clutch 12*m*. Accordingly, the developing sleeve 12*d*-2 rotates.

It is to be noted that, as the supply-screw driving gear 12*n* meshing with the developing driving input gear 12*j* rotates in the direction indicated by arrow D (hereinafter "rotation direction D") in FIG. 3A, the supply screw 12*f* rotates. The conveying-screw driving gear 12*o* rotates in the direction identical to the rotation direction D of the supply-screw driving gear 12*n*, via an idle gear between the supply-screw driving gear 12*n* and the conveying-screw driving gear 12*o*.

By contrast, when the photoconductor 10 is rotated in reverse to inhibit defective cleaning of the photoconductor 10, the drive transmission device according to the present embodiment operates as follows.

As the photoconductor driving gear 10*c* illustrated in FIG. 2 rotates in the direction reverse to the normal direction for image formation, the developing driving gear 12*i* (illustrated in FIGS. 1 and 2), which meshes with the photoconductor driving gear 10*c*, rotate in the direction reverse to the rotation direction A illustrated in FIG. 3A. Then, the developing driving input gear 12*j*, which is disposed on the identical shaft to which the developing driving gear 12*i* is disposed, rotates in the direction indicated by arrow E (hereinafter "rotation direction E") illustrated in FIG. 3B. This rotation is transmitted to the developing sleeve gear 12*k* meshing with the developing driving input gear 12*j*, and the developing sleeve gear 12*k* rotates in the direction indicated by arrow F (hereinafter "rotation direction F") illustrated in FIG. 3B.

At that time, the one-way clutch 12*m* does not mesh with the rotation shaft 12*l* of the developing sleeve 12*d*-2, and the developing sleeve gear 12*k* and the one-way clutch 12*m* rotate idle. As a result, the rotation shaft 12*l* of the developing sleeve 12*d*-2 does not rotate.

It is to be noted that the supply-screw driving gear 12*n* meshing with the developing driving input gear 12*j* rotates in the direction indicated by arrow H (hereinafter "rotation direction H") in FIG. 3B.

With this configuration, when the photoconductor 10 rotates in the direction reverse to the normal direction for image formation, the rotation shaft 12*l* of the developing sleeve 12*d*-2 does not rotate. Accordingly, the flowing-out airflow, which is generated by reverse rotation of the developing sleeve 12*d*-2, does not occur in the present embodiment, thereby inhibiting the leak of developer from the casing 12*a* (the developer container) of the developing device 12.

Further, in the present embodiment, even when the developing sleeve 12*d*-2 is kept stationary, the supply screw 12*f* and the conveying screw 12*e* are rotated in reverse to stir the developer, thereby securing toner charge. Thus, insufficient charge of toner in subsequent image formation is inhibited. Although the reverse rotation of the supply screw 12*f* and the conveying screw 12*e* cause slight airflow in the developing device 12, the developer on the developing sleeve 12*d*-2, which is not rotating, is retained in the gap between the upper case 12*c* (in FIG. 6) and the developing sleeve 12*d*-2 due to the magnetic force exerted by the third magnetic pole of the developing sleeve 12*d*-2. Accordingly, the airflow inside the developing device 12 does not become the flowing-out airflow at the opening 22 illustrated in FIG. 8.

It is to be noted that the configuration to inhibit transmission of the driving force to the shaft of the developer bearer is not limited to the one-way clutch 12*m*. Alternatively, for example, one (e.g., the developing sleeve gear 12*k*) of the gears disposed between the photoconductor driving gear 10*c* and the rotation shaft 12*l* of the developing sleeve 12*d*-2 may be moved in the axial direction to disconnect the drive transmission to the rotation shaft 12*l* of the developing sleeve 12*d*-2 during reverse rotation of the photoconductor 10.

It is to be noted that the inconveniences caused by the reverse rotation of the developer bearer can occur also in configurations in which generation of the sucking-in airflow during image formation is inhibited.

The various aspects of the present specification can attain specific effects as follows.

Aspect A

A developing device includes a developer bearer, such as the developing roller 12*d*, to bear developer on a surface thereof and transport, by rotation, the developer to a developing range facing a latent image bearer, such as the photoconductor 10. In the developing range, the developer bearer supplies the developer to a latent image on the latent image bearer. When a rotation shaft of the latent image bearer rotates in a direction reverse to a normal direction for image formation, receiving a driving force from a driving source, the driving force from the driving source is not transmitted to a rotation shaft of the developer bearer.

According to this aspect, when the rotation shaft of the latent image bearer rotates in the direction reverse to the normal direction for image formation, the rotation shaft of the developer bearer does not rotate. Therefore, the inconveniences caused by the reverse rotation of the developer bearer are inhibited.

Aspect B

The developing device according to Aspect A further includes a casing 12*a* serving as a developer container to contain the developer supplied to the surface of the developer bearer, and the developer bearer is disposed in the casing 12*a*. The casing includes an opening 22 to make the inside of the casing communicate with the developing range and generate airflow flowing to the inside of the casing as the rotation shaft of the developer bearer rotates in the normal direction for image formation. With the airflow, toner is collected inside the casing.

As described above, the photoconductor is rotated in reverse, for example, to inhibit defective cleaning of the photoconductor. However, if the developer bearer rotates in the reverse direction together with the photoconductor rotating in the revere direction, it is possible that air flows out the casing 12*a* through the opening 22. In this case, it is possible that the toner leaks outside the casing, being transported by the flowing-out airflow.

According to this aspect, when the rotation shaft of the latent image bearer rotates in the direction reverse to the normal direction for image formation, rotation driving is not transmitted to the rotation shaft of the developer bearer, and accordingly the developer bearer does not rotate in the direction reverse to the direction for image developing. Therefore, in the opening, the flowing-out airflow does not occur. Accordingly, the developer is inhibited from leaking through the opening.

Aspect C

In Aspect A or B, the drive transmission device includes a one-way clutch 12*m* to rotate only in the direction in which the rotation shaft of the developer bearer rotates for image formation. The one-way clutch 12*m* is disposed in a drive transmission train to transmit a driving force from the driving source to the rotation shaft of the developer bearer.

According to this aspect, with a simple structure, the drive transmission device can be configured not to transmit the driving force to the rotation shaft of the developer bearer when the rotation shaft of the latent image bearer rotates in the direction reverse to the normal direction for image formation. Thus, the cost of the drive transmission device can be lower.

Aspect D

In Aspect C, the one-way clutch is attached to the rotation shaft of the developer bearer.

According to this aspect, compared with an arrangement in which the one-way clutch is disposed between the rotation shaft of the developer bearer and the output shaft of the driving source, the space to accommodate the one-way clutch is reduced, and the device can be kept compact.

Aspect E

An image forming apparatus includes, at least, the latent image bearer to bear an electrostatic latent image thereon, a charging device to charge the surface of the latent image bearer, a latent image forming device to form the electrostatic latent image on the latent image bearer, and the developing device, according to any one of Aspects A through C, to develop the electrostatic latent image.

According to this aspect, even when the rotation shaft of the latent image bearer rotates in the direction reverse to the normal direction for image formation, the rotation shaft of the developer bearer does not rotate, and accordingly leak of developer caused by the reverse rotation of the developer bearer is inhibited. Accordingly, the interior of the image forming apparatus is protected from contamination with the leaked developer.

Aspect F

Aspect N: A process cartridge that is removably installable in an apparatus body of an image forming apparatus includes at least the latent image bearer to bear a latent image, the developing device according to any one of Aspects A through C, and a common holder to hold those components.

According to this aspect, even when the rotation shaft of the latent image bearer rotates in the direction reverse to the normal direction for image formation, the rotation shaft of the developer bearer does not rotate, and accordingly leak of developer caused by the reverse rotation of the developer bearer is inhibited. Accordingly, the interior of the process cartridge is protected from contamination with the leaked developer.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

a latent image bearer having a shaft to rotate in a normal direction for image formation and a reverse direction to the normal direction;

a charging device to charge a surface of the latent image bearer;

a latent image forming device to form a latent image on the latent image bearer;

a developing device including a developer bearer having a shaft to rotate in a predetermined direction during image formation, the developer bearer to transport developer including toner to a developing range facing the latent image bearer to develop the latent image on the latent image bearer;

a driving source; and a drive transmission device to transmit a driving force from the driving source to the shaft of the latent image bearer and the shaft of the developer bearer, the drive transmission device to inhibit transmission of the driving force to the shaft of the developer bearer when the latent image bearer rotates in the reverse direction.

2. The image forming apparatus according to claim 1, wherein the drive transmission device includes a one-way clutch disposed in a drive transmission train to transmit the driving force from the driving source to the shaft of the developer bearer, and wherein the one-way clutch rotates the shaft of the developer bearer only in the predetermined direction.

3. The image forming apparatus according to claim 2, wherein the one-way clutch is attached to the shaft of the developer bearer.

4. The image forming apparatus of claim 1, wherein:

the developing device further includes a developer conveyor to convey and stir the developer, and when the latent image bearer rotates in reverse, the developer bearer is not driven, but the developer conveyor is driven.

5. A developing device comprising:

a developer bearer having a shaft to rotate in a predetermined direction during image formation, the developer bearer to transport developer including toner to a developing range facing a latent image bearer to develop a latent image on the latent image bearer;

a casing to contain the developer and accommodate the developer bearer, the casing having an opening via which an inside of the casing communicates with the developing range; and a one-way clutch attached to the shaft of the developer bearer to inhibit transmission of a driving force from a driving source to the shaft of the developer bearer when the latent image bearer rotates in a reverse direction to a normal direction for image formation.

6. The image forming apparatus according to claim 5, wherein, as the shaft of the developer bearer rotates in the predetermined direction, airflow flowing from outside into the casing is generated at the opening.

7. A process cartridge to be removably installed in an image forming apparatus, the process cartridge comprising:

the latent image bearer to bear the latent image;

the developing device according to claim 5 to develop the latent image on the latent image bearer; and a common holder to hold the latent image bearer and the developing device as a single unit.

* * * * *